US006857456B2

(12) United States Patent
Manning

(10) Patent No.: US 6,857,456 B2
(45) Date of Patent: Feb. 22, 2005

(54) WORKBENCH

(76) Inventor: Geoffrey Manning, c/o Eazi-Way, 38 Sunninghill Village, Abingdon (GB), OX13 6XD ( * ) Notice: Subject to any disclaimer, the term of this patent is extended or adjusted under 35 U.S.C. 154(b) by 379 days.

(21) Appl. No.: 09/929,447

(22) Filed: Aug. 14, 2001

(65) Prior Publication Data

US 2003/0034088 A1 Feb. 20, 2003

(51) Int. Cl.[7] ..... B25H 1/00
(52) U.S. Cl. ..... 144/286.5; 83/477.2
(58) Field of Search ..... 144/286.1, 286.5, 144/287, 1.1, 2.1, 3.1; 269/289 R, 290, 291, 293; 83/469, 471, 472, 477, 477.2, 478, 479

(56) References Cited

U.S. PATENT DOCUMENTS 3,734,151 A 5/1973 Skripsky
4,114,665 A * 9/1978 Decker ..... 144/1.1
4,335,765 A * 6/1982 Murphy ..... 108/92
5,067,535 A 11/1991 Wolff
5,431,206 A 7/1995 McAllister
5,882,155 A 3/1999 Testa, Jr.

FOREIGN PATENT DOCUMENTS

GB 2144365 * 3/1985

* cited by examiner

*Primary Examiner*—Allen Ostrager
*Assistant Examiner*—Shelley Self
(74) *Attorney, Agent, or Firm*—Thompson Hine LLP

(57) ABSTRACT

A transportable workbench comprises a work surface having at least two locations for receiving and retaining power tools. An adjustable stop is demountably attached to the workbench relative to each location to enable a workpiece while in contact with the stop to be machined by way of a power tool retained at one of the locations. Typically each location comprises a recess or aperture adapted to receive demountably a plate to which a power tool can be secured so that, when the plate with the power tool is mounted in the location, the power tool is presented relative to the work surface to enable the tool to provide a machining operation on a workpiece positioned on or by means of the work surface.

5 Claims, 3 Drawing Sheets

WORKBENCH

BACKGROUND OF THE INVENTION

1. Field of the Invention

This invention relates to a workbench. It is particularly concerned with a transportable workbench to which a power operated tool can be demountably attached to facilitate use of the tool at a temporary location. Such a workbench provides a stable location for the power tool.

2. Description of the Prior Art

Workbenches for mounting power tools are known and examples of such workbenches are disclosed in GB 2 144 365, U.S. Pat. No. 5,882,155, U.S. Pat. No. 5,431,206, U.S. Pat. No. 5,067,535, U.S. Pat. No. 4,335,765, U.S. Pat. No. 4,114,665 and U.S. Pat. No. 3,734,151. However, such workbenches have various inconveniences and disadvantages.

SUMMARY OF THE INVENTION

According to the first aspect of the invention, there is provided a transportable workbench comprising: a plurality of locations, each of which defines an aperture for passage of a tool of a power tool; and a single adjustable stop, also known as a fence, for guiding a work piece during a machinery operation with respect to any one of said locations.

The workbench may comprise a work surface (also referred to herein as a work top). The work surface may have an edge and the stop may be moveable perpendicularly to the edge and clampable with respect to the work surface. The stop may be elongated and may be clampable substantially parallel to the edge.

The location may comprise at least two locations at the work surface for mounting respective ones of the power tools having cutting tools defining a single cutting line. The single cutting line may be parallel to the edge. The workbench may comprise at least one scale for positioning the stop and having a reference mark intersected by the cutting line. The power tools may comprise at least one power saw and optionally a router.

The workbench may comprise an upstanding plate projecting substantially perpendicularly from the work surface. The locations may comprise at least two locations at the plate. A power plane, also known as a planer, and a power sander may be provided at these locations.

Each of at least one of the locations may comprise a template for positioning the power tool with respect to the workbench and a clamping arrangement for clamping the power tool to the workbench. The clamping arrangement may comprise at least one lever mounted on and pivotable with respect to the template for urging the template against the workbench. The clamping arrangement may comprise at least one lever mounted on and pivotable with respect to the template for urging a plate of the power tool against the workbench.

The workbench may comprise electrical coupling means for connection to the power tool and to a source of electrical power. The electrical coupling means may include switch means for electrically isolating the power tool from the source of electrical power. The electrical coupling means may include a voltage or current sensitive device responsive to the operating voltage or current or rate of change of operating current or voltage differing from a predetermined value by more than a predetermined amount to isolate the power tool from the source of electrical power.

Two of the locations may be equipped with power tools to provide first and second work stations, the work stations being juxtaposed for machining a work piece sequentially with a first machining stage at the first work station and a second machining stage at the second work station. The stop may be arranged to regulate positioning of the work piece for or during machining at least one of the workstations and/or transferring the work piece between the first and second work stations.

According to a second aspect of the invention, there is provided a transportable workbench comprising a plurality of locations, each of which defines an aperture for passage of a tool of a power tool, two of the locations being equipped with power tools to provide first and second work stations, the work stations being juxtaposed for machining a work piece sequentially with a first machining stage at the first work station and a second machining stage at the second work station.

According to a third aspect of the invention, there is provided a transportable work bench comprising a plurality of locations, each of which defines an aperture for passage of a tool of a power tool, at least two of the locations for power cutting tools defining a single cutting line.

According to a fourth aspect of the invention, there is provided a transportable work bench comprising a plurality of locations, each of which defines an aperture for passage of a tool of a power tool, each of at least one of the locations comprising a template for positioning a respective one of the power tools and a hand-operated clamping arrangement on the template for clamping the respective power tool and the template to the workbench.

It is thus possible to provide a workbench which is capable of mounting various different power tools in a convenient arrangement which facilitates use of the power tools. All of the tools can be mounted at the same time and each may be used independently of the presence of the others. In a typical example, five tools are mounted on the workbench and comprise a jigsaw, a circular saw, a router, a plane and a belt sander.

It is possible to provide templates which are capable of being customised by a user so as to adapt them to substantially any make and model of tool. The templates locate the tools in place and provide clamps for holding the tool to the workbench. No modification is required and substantially any normally hand-held power tool may be mounted to the workbench in the correct position. Typically, each tool can be mounted on or dismounted from the workbench in about a minute by adjusting a few hand operated clamps. No fixing holes are required in the workbench.

It is possible to provide a single stop in the form of a work fence which can be used to guide a work piece by all of the tools mounted on the workbench. Some power tools, such as a plane and a belt sander, can be mounted and cooperate with the work fence in such a way that the machining operations are performed sequentially on each work piece with the work fence guiding the work piece past each tool. Appropriate tool guards may be mounted on the work fence. It is possible to mount power cutting tools, such as saws and routers, on a single cut line, for example parallel to a long edge of the workbench. A work piece can then be guided by the work fence past more than one of the tools without requiring any intermediate adjustment. The work fence can be adjusted with respect to the cut line by the use of a scale whose "zero" or reference position is on or "intersected" by the cut line.

BRIEF DESCRIPTION OF THE DRAWINGS

The invention will be further described, by way of example, with reference to the accompanying drawings, in which.

DETAILED DESCRIPTION OF THE PREFERRED EMBODIMENTS

Figure 1:
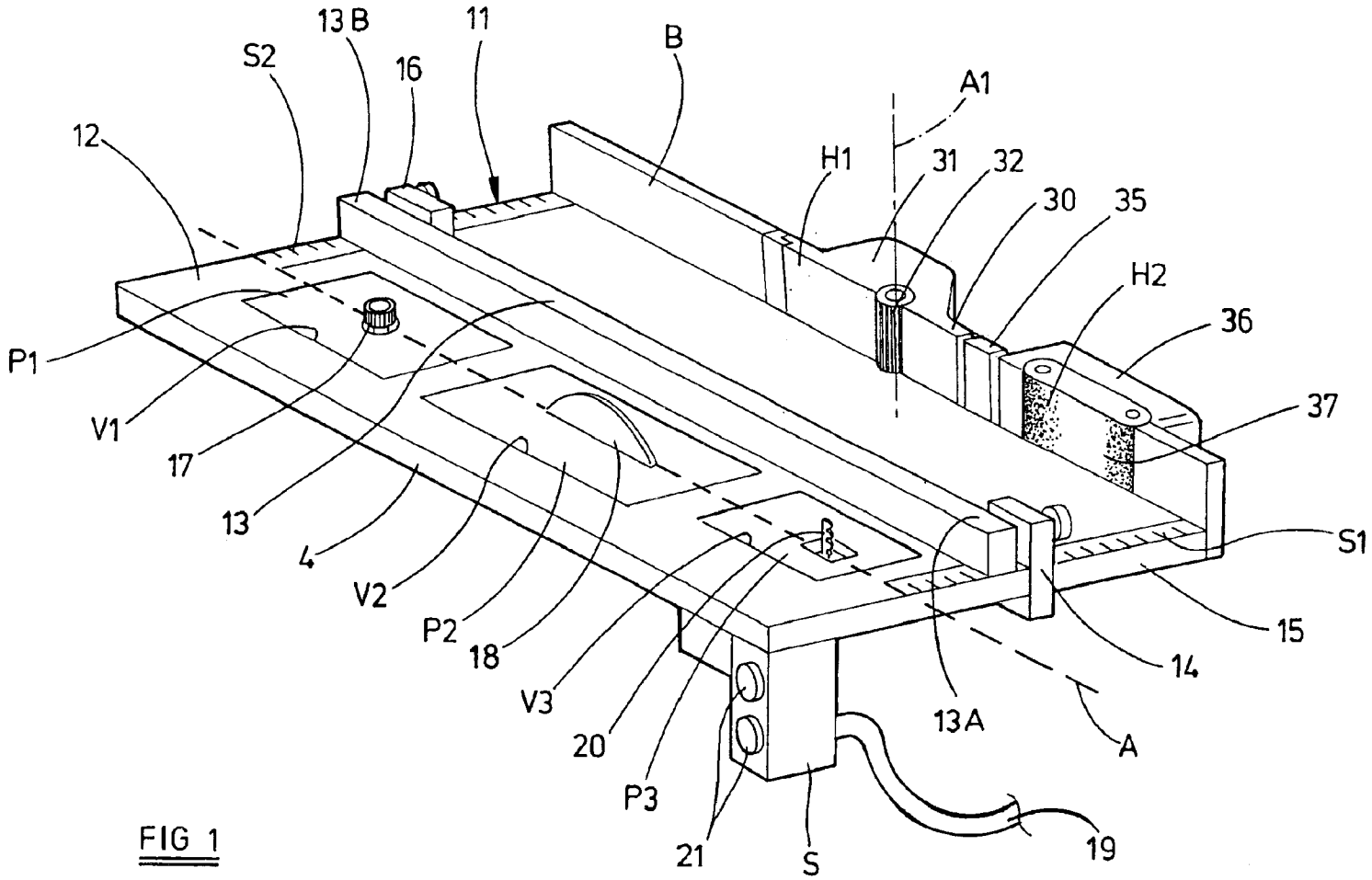
FIG. 1 is a perspective view of a first workbench constituting an embodiment of the invention.

A workbench 11 comprises a work top 12 with a back plate B mounted on a folding leg frame which, for the sake of clarity, is omitted from the drawing to avoid undue complexity.

The worktop 12 includes three locations V1, V2, V3 extending through it. Each location V1–V3 includes a vertical aperture and is arranged to demountably receive and retain a powered tool by way of a mounting plate as will be described hereinafter.

A work fence 13 has an end 13A located on the bench 11 by way of clamp 14. The end 13A can be displaced along a side 15 of the work top 12 to allow for ready variation in, and securing of, the position of the fence 13 on the work top 12. A given position can, if necessary, be established or identified with reference to a scale S1. The fence 13 is similarly equipped at its end 13B with a clamp 16 for establishing the position of the end 13B if necessary with reference to scale S2.

Locations V1–V3 each comprise an aperture through the work top 12 in which a respective metal plate P1–P3 can be demountably attached so that the upper surface of each plate P1–P3 is flush with the upper surface of the work top 12.

The location V1 is fitted with the plate P1 which has mounted on it a router (lying mainly beneath the plate P1) whose cutting head 17 is shown projecting above the worktop 12. The router is coupled to a power supply block S located beneath the worktop 12. The supply unit S is coupled to a main power supply by a cable 19. The power supply to and from the block S can be regulated by buttons 21.

The location V2 is fitted with the plate P2 which has mounted on it a circular saw (lying beneath the plate P2) whose saw blade 18 is shown projecting above the worktop 12. The saw is powered by way of the power supply block S.

The location V3 is fitted with the plate P3 which has mounted on it a jigsaw (lying beneath the plate P3) whose cutting head 20 is shown projecting above the surface of the work top 12. The jigsaw is powered by way of the power supply block S.

The back plate B has two locations H1, H2 each arranged to demountably receive and retain a powered tool by way of a mounting as will be described hereinafter.

Location H1 is fitted with a mounting 30 for the demountable retention of a planer 31 whose cutting rotor 32 is rotatable about a vertical axis A1. The thickness of cut can be varied by means of controls on the planer 31. The planer 31 is coupled to the power supply block S.

The location H2 is fitted with a mounting 35 for the demountable retention of a belt sander 36 whose sanding belt 37 projects into the side area of the work top 12.

The workbench 11 provides for the ready mounting of a plurality of power tools on a rigid worktop so that they can be used separately or more usually in combination in a selected workplace. The fence 13 can readily be positioned and secured so as to be usable to align a work piece with any one or more of the power tools located in any of the positions provided in locations V1 to V3 and H1, H2.

In addition, the fence 13 with any other added guides can be used to facilitate a sequence of operations involving the transfer of a work piece from a first machining operation carried out by a power tool at one location to a second location for a further machining operation.

If necessary further or alternative guide members can be added to facilitate the carrying out of machining operations on a work piece. Typically the worktop can be equipped with a pattern of slots, holes or recesses to provide for the optimal alignment of a work piece on any part of the worktop 12.

The invention is not limited to the power tools described in the exemplary embodiment. Typically a drill stand can be incorporated to enable a drill to be accurately aligned with a work piece. Indeed any power tool which can usefully be located to present a tool or tools to a support surface provided by the workbench for operation on a work piece can be readily accommodated in the workbench of the present invention.

The term 'power tool' is to be interpreted widely. It includes devices such as sources of compressed air to help blow clear the worktop or items or nearby locations being worked on. It can include an air extraction device for drawing dust, chips, filings or other waste material from the working area which can become intrusive particularly when more than one tool is in use. Lighting can also be provided.

The workbench of the present invention provides a major safety benefit in ensuring that electrical power and its control are dealt with in a safe manner which can be particularly significant in the context of portable tooling. Apart from providing for the safe alignment of power cables supplying the individual tools from a central power supply block, it also provides for a single clearly evident switch to be operable to isolate all the power tools when in use. Thus a passer-by, while having no clear idea of what is in use and how controlled, can, in the event of an accident to a user of the workbench, isolate the workbench from a main power supply by operating a clearly marked button.

The worktop or surface 12 has a front edge 4 which extends along the front of the workbench. The power cutting tools mounted at the locations V1–V3 are located in such a way that their cutting tools define a single common cut line A illustrated by a broken line. The cut line A is parallel to the front edge 4 and intersects or passes through the zero reference points or markers of the scales S1 and S2. The work fence 13 may thus readily be set, with the help of the scales S1 and S2, with respect to the cut line in relation to the cutting tools comprising the jigsaw, the circular saw and the router. Similarly, the work fence 13 can be set in relation to the plane 31 and the belt sander 36 so that planing and sanding operations may be performed on a workpiece in sequence with the work piece being guided by the work fence 13.

Figure 2:
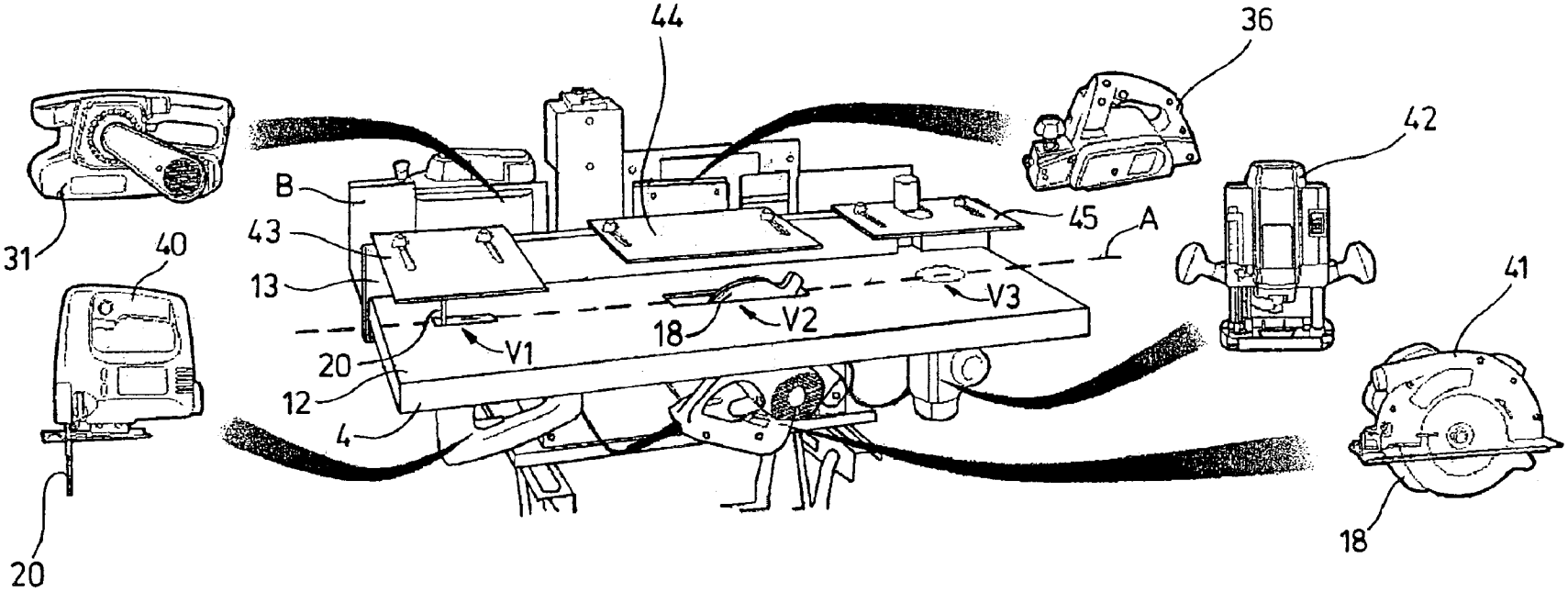
FIG. 2 is a perspective view of a second workbench constituting an embodiment of the invention.

FIG. 2 illustrates another workbench of a similar type to that illustrated in FIG. 1 with like reference numerals referring to like parts. This drawing illustrates that normally hand-held power tools may be mounted to the workbench. In this example the locations V1 to V3 are used for mounting a jigsaw 40, a circular saw 41 and a router 42, respectively. The plane 32 and the sander 36 are likewise illustrated mounted on and dismounted from the workbench. FIG. 2 also shows tool guards 43 to 45 mounted to the work fence 13 for protecting a user from injury.

Figure 3:
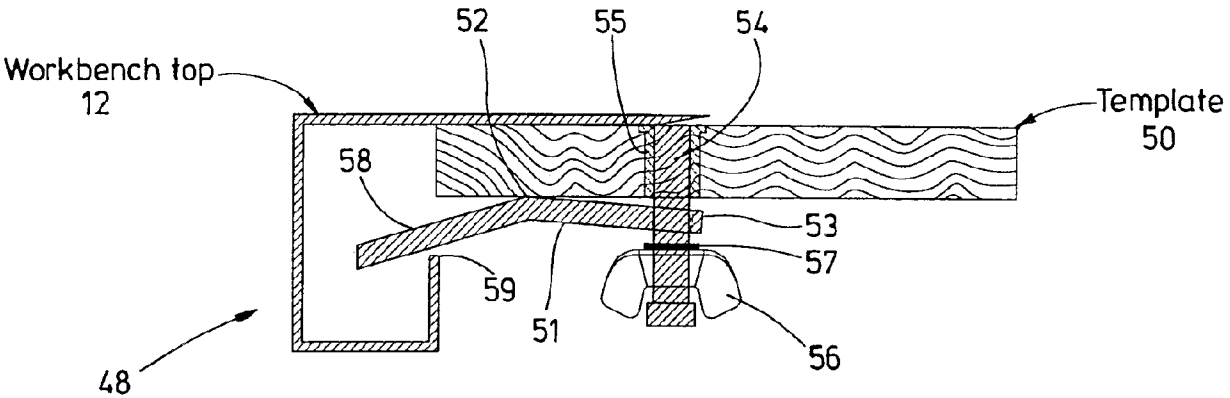
FIG. 3 is a cross sectional view of a template and a clamp for holding the template to the workbench.
Figure 4:
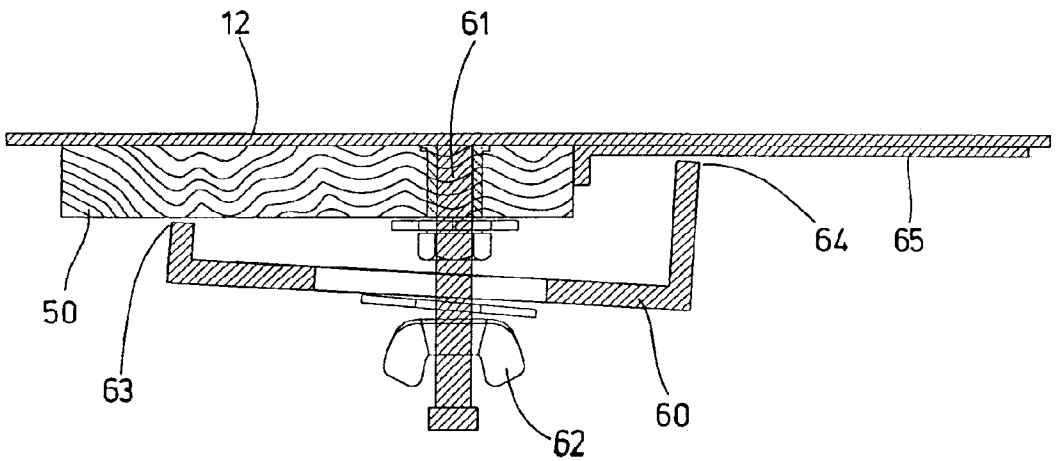
FIG. 4 is a cross sectional view of the template and another clamp for holding a power tool to the workbench.

FIGS. 3 and 4 illustrate a template and clamping arrangement for mounting each of the power tools to the workbench. The workbench is made of sheet metal folded to provide open box sections such as that illustrated at 48. Each template 50 is, for example, made of wood and is used to mount a power tool to the workbench such that the power tool is held securely in the correct position. FIG. 3 illustrates the clamping arrangement for holding the template to the workbench.

The clamping arrangement comprises a strip of metal in the form of a lever 51 which pivots about a pivot point 52. One end 53 of the lever has a hole through which a threaded stud 54 passes. The stud is held rigidly in a sleeve 55 in the template 50 and a captive hand-operated wing nut 56 provided with a washer 57 urges the lever end 53 towards the template 50 for securing the template in position.

The other end 58 of the leaver passes into the box section 48 and engages against an edge 59 of the box section for holding the template 50 in position. In particular, in order to mount the template to the workbench, the wing nut 56 is unscrewed and the template 50 is placed in position against stops or the like (not shown) for ensuring the correct location and alignment of the power tool. Each lever 51 is disposed so that its end 58 enters an adjacent box section such as 48 and the wing nut 56 is screwed by hand towards the template 50 so that the template is urged against and secured with respect to the undersurface of the bench top 12.

The power tool to be mounted is held in place by the arrangement illustrated in FIG. 4. One or more further levers 60 are mounted on the template 50 by a threaded stud 61 and hand-operated wing nut 62 of the same type as illustrated in FIG. 3. The lever 60 has a first end 63 which is urged against the template 50 so as to form a lever pivot. The other end 64 of the lever 60 engages the power tool to be mounted, for example by engaging a plate 65 of the power tool.

When the power tool is to be mounted to the workbench, the appropriate template 50 is first mounted to the workbench by the clamping arrangement illustrated in FIG. 3. The power tool is then mounted and secured by the clamping arrangement shown in FIG. 4. In particular, after mounting the template 50, the wing nut 62 releases the lever 60 so that the power tool may be placed in the correct position by the template 50. The lever 60 is then positioned so that its end 64 abuts below the plate 65 and the wing nut is manually tightened so as to secure the power tool in position against the lower surface of the work top 12.

In order to remove the power tool, the wing nut 62 is manually undone so that the lever 60 of each clamping arrangement is released and allows the power tool to be removed from the workbench. The template may be left in place if the same type of power tool is subsequently to be remounted on the bench. However, if a different type of tool is to be mounted at the same location, then the template 50 may be removed and replaced by another template specifically adapted for the next tool to be mounted. The template 50 is dismounted by manually unscrewing the wing nut 56 and moving the lever 51 out of the box section 48 for each template clamping arrangement.

A user may mount any make and type of power tool to the workbench by customizing a "blank" template. In particular, templates may be provided for customizing by the user such that all of the templates are positioned in the same way on the workbench. The user may then, for example, provide the appropriate cut out in the template so that the power tool which it is desired to mount is accurately positioned and aligned by the template when mounted to the workbench.

Power tools may therefore be mounted and dismounted rapidly by hand and without requiring any special tools. The template and clamping arrangement is such that no drilling of the workbench is required in order to mount the power tools. This provides a very convenient arrangement for mounting and dismounting a variety of makes and types of tools in accordance with the requirement of the user.

The cut line A shown in FIGS. 1 and 2 is defined by the cutting directions of the power cutting tools mounted to the workbench. In the illustrated examples, the jigsaw blade 20 and the circular saw blade 18 have well-defined cutting directions and these are collinear to define the cut line A in the work top 12 of the workbench. The router tool 17 does not have a single direction of cut but does have an axis of rotation and this axis is intersected by the cut line A so as to define a common cut line for all of the power cutting tools parallel to the front edge 4 of the workbench. The work fence 13 is adjustable in a direction perpendicular to the edge 4 and can be clamped by means of the clamps 14 and 16 shown in FIG. 2 so as to be parallel to the cut line A and the edge 4.

It is thus possible to provide a workbench which is very convenient and safe to use. Work fence adjustment is relatively simple and a single work fence suffices for all of the power tools mounted to the bench. Where appropriate, sequential machining operations can be performed and guided or controlled by the single work fence. Normally hand-held power tools can be quickly and easily mounted to and dismounted from the bench and different types and makes of tool can easily be provided for.

What is claimed is:

1. A transportable workbench comprising:

a work surface having an edge;

a plurality of locations at said work surface, each of which defines an aperture for passage of a tool of a power tool, wherein said locations comprise at least two locations for mounting respective ones of said power tools having cutting tools defining a single cutting line;

a single adjustable stop for guiding a workpiece during a machining operation with respect to any one of said locations, said stop being movable perpendicularly to said edge and being clampable with respect to said work surface; and at least one scale for positioning said stop and having a reference mark intersected by said cutting line.

2. A transportable workbench comprising:

a work surface;

an upstanding plate projecting substantially perpendicularly from said work surface;

a plurality of locations at said plate, each of which defines an aperture for passage of a tool of a power tool; and a single adjustable stop operatively connected to the work surface for guiding a workpiece during a machining operation with respect to any one of said locations.

3. A workbench as claimed in claim 2, in combination with a power plane at one of said at least two locations.

4. A workbench as claimed in claim 2, in combination with a power sander at one of said at least two locations.

5. A transportable workbench comprising:

a table top having a work surface with a longitudinal edge, the table top having a plurality of apertures therethrough, said apertures being shaped to receive a plurality of power tool tools;

at least two of said apertures being positioned on said table top such that associated power tool tools extending therefrom form a cutting line, substantially parallel to said edge, for performing a plurality of machining operations on a single workpiece with a single pass;

a stop extending upwardly from said work surface and adjustably mountable on said table top adjacent to said apertures for guiding a workpiece during a machining operation by a selected one of said associated power tools;

a plate mounted on said table top and extending substantially upwardly therefrom, said plate having an aperture for receiving power tool tools;

a source of electrical power for associated power tools mounted on said workbench, said power source being mounted on said workbench and connectable to an external power source and having a power shut-off switch for shutting off power to said associated power tools;

a scale mounted on the work surface for positioning said stop and having a reference mark thereon intersected by said cutting line; and a template shaped to receive and attach to a specific power tool and a clamp for attaching said template and said associated power tool to said table top, said clamp including a pivoting lever for urging said associated power tool against said table top.

* * * * *